US005586700A

United States Patent [19]

Fitzner et al.

[11] Patent Number: 5,586,700

[45] Date of Patent: Dec. 24, 1996

[54] MAIL CARRIER

[76] Inventors: John E. Fitzner, 1006 Floral Ave., Schenectady, N.Y. 12306; Thomas J. McCoy, 4 St. Marie St., Schenectady, N.Y. 12303

[21] Appl. No.: 336,258

[22] Filed: Nov. 8, 1994

[51] Int. Cl.[6] ..... A45C 13/26

[52] U.S. Cl. ..... 224/219; 224/267; 224/652; 224/654

[58] Field of Search ..... 224/191, 202, 224/205, 208, 210, 211, 219, 220, 224, 226, 228, 267, 907, 652, 654; 190/115, 117; 150/107; 383/36

[56] References Cited

U.S. PATENT DOCUMENTS

| | | | |
|---|---|---|---|
| 214,823 | 4/1879 | Hopkins | 150/107 |
| 306,863 | 10/1884 | Robinson . | |
| 516,097 | 3/1894 | King et al. . | |
| 633,884 | 9/1899 | McCarthy | 224/191 |
| 641,987 | 1/1900 | McCarthy | 224/191 |
| 770,354 | 9/1904 | Corfman . | |
| 909,325 | 1/1909 | Patch | 190/115 |
| 1,187,913 | 6/1916 | Jackson et al. | 224/205 |
| 1,431,032 | 10/1922 | Patzkowski . | |
| 1,498,455 | 6/1924 | Johnson . | |
| 1,513,514 | 5/1924 | London . | |
| 2,679,877 | 10/1952 | Leggett . | |
| 4,079,871 | 3/1978 | Sica | 224/226 |
| 4,150,464 | 4/1979 | Tracy | 24/77 R |
| 4,171,555 | 10/1979 | Bakker et al. | 24/200 |
| 4,236,559 | 12/1980 | Archbold | 224/205 |
| 4,390,088 | 6/1983 | Brenner | 190/51 |
| 4,856,570 | 8/1989 | Rushing et al. | 150/107 |
| 4,859,084 | 8/1989 | Kaumeyer | 383/39 |
| 5,002,401 | 3/1991 | Blackman | 383/38 |
| 5,024,361 | 6/1991 | Flowers | 224/223 |
| 5,061,086 | 10/1991 | Vallerga | 383/16 |
| 5,160,001 | 11/1992 | Marceau | 190/115 |
| 5,209,385 | 5/1993 | Ledesma | 224/224 |
| 5,255,833 | 10/1993 | McAllister | 224/202 |
| 5,275,318 | 1/1994 | Catania | 224/224 |
| 5,395,022 | 3/1995 | Vandewall | 224/224 |

FOREIGN PATENT DOCUMENTS

| | | | |
|---|---|---|---|
| 2700676 | 7/1994 | France | 224/210 |
| 82752 | 11/1953 | Norway | 224/210 |

*Primary Examiner*—David J. Walczak
*Assistant Examiner*—Charles R. Eloshway
*Attorney, Agent, or Firm*—Heslin & Rothenberg, P.C.; Wayne F. Reinke, Esq.

[57] ABSTRACT

A first mail carrier includes a stiff flat back portion, an open pouch connected at the bottom of the back portion at a lower half thereof, a stiff flat flap connected at each side of the back portion and a handle connected to each flap. The pouch includes elastic at the top for ensuring that mail carrier contents do not fall out. A second mail carrier includes a sack, a rigid member connected to the top of the sack for holding the sack open and for retaining the shape thereof, a strap connected to the sack that may include a quick attach/release mechanism and/or a strap adjuster, and a cover flap for the sack. The mail carriers may be used together as a mail carrier system for carrying different sized mail.

14 Claims, 2 Drawing Sheets

MAIL CARRIER

BACKGROUND OF THE INVENTION

1. Technical Field

The present invention generally relates to tote bags. More particularly, the present invention relates to mail bags or mail carriers.

2. Background Art

In the past, the postal service has provided mailpersons with mail for an address on their individual route separated into letter-sized mail and larger than letter-sized mail. Today, the postal service is moving away from this practice to one where, through computerized sorting, all the mail for a given address is lumped together.

Since the postal service has begun to provide mail to mailpersons in this manner, a mailperson is faced with the difficult task of efficiently carrying the mail for delivery. The bags that are currently used for delivering the mail are cumbersome and inefficient. In addition, carrying mail in the arms of the mailperson reduces the amount of mail that can be carried and invites the possibility of dropping some of the mail on the ground. It would be helpful to mailpersons if mail carriers were available that were specifically designed to carry mail of different sizes.

Thus, a need exists for mail carriers specifically designed to allow a mailperson to carry mail according to size categories.

SUMMARY OF THE INVENTION

Briefly, the present invention satisfies the need for mail carriers designed to carry mail according to size by providing coordinated mail carriers including a first mail carrier for carrying letter-sized mail, and a second mail carrier for carrying larger than letter-sized mail.

In accordance with the above, it is an object of the present invention to provide mail carriers for carrying mail according to size.

It is another object of the present invention to provide a mail carrier for carrying letter-sized mail.

It is a further object of the present invention to provide a mail carrier for carrying larger than letter-sized mail.

The present invention provides, in a first aspect, a mail carrier for assisting a mailperson with carrying mail, comprising a flat back portion having a top edge and two side edges and an open pouch connected to the flat back portion at a lower half thereof. The mail carrier may also comprise a pair of handles, each handle being coupled to one of the two side edges of the flat back portion. The mail carrier may further comprise a pair of moveable flaps, each moveable flap being connected between one of the two side edges of the flat back portion and one of the pair of handles. In addition, the flat back portion may be stiff, and the pair of flaps may be stiff. Still further, the mail carrier may comprise a water-repelling flap connected at the top edge of the flat back portion for covering the contents thereof.

The present invention provides, in a second aspect, a mail carrier for assisting a mailperson with carrying mail, comprising a sack, a rigid member connected to the top of the sack for holding the sack open and retaining the shape thereof, and a strap connected to the sack for carrying same. The sack includes a front panel, a back panel, two side panels connecting the front panel and the back panel, and a bottom panel connected to each of the front panel, back panel and two side panels. The mail carrier may also comprise a cover flap for the sack connected to back panel at a connection area. The rigid member may comprise a metal rod connected to the sack at the top of each of the front panel and two side panels. In addition, the strap may comprise a quick attach/release mechanism and/or a strap adjuster.

In a third aspect of the present invention, a mail carrier system is provided. The mail carrier system includes the mail carrier of the first aspect and the mail carrier of the second aspect. The mail carrier of the first aspect is used to carry larger than letter-sized mail, and the mail carrier of the second aspect is used to carry letter-sized mail. The mail carrier of the first aspect may be held in the arm of a mailperson or worn on a mailperson's forearm, and the mail carrier of the second aspect may be worn on the shoulder or around the mailpersons's waist. The mail carrier system of the third aspect frees one arm of the mail carrier for delivery of the mail that has been sorted according to size.

These, and other objects, features and advantages of this invention will become apparent from the following detailed description of the various aspects of the invention taken in conjunction with the accompanying drawings.

BRIEF DESCRIPTION OF THE DRAWINGS

FIG. 5 is a cross-sectional view taken along 5—5 of FIG. 1.

FIG. 6 is a cross-sectional view taken along 6—6 of FIG. 1.

BEST MODE FOR CARRYING OUT THE INVENTION

Figure 1:
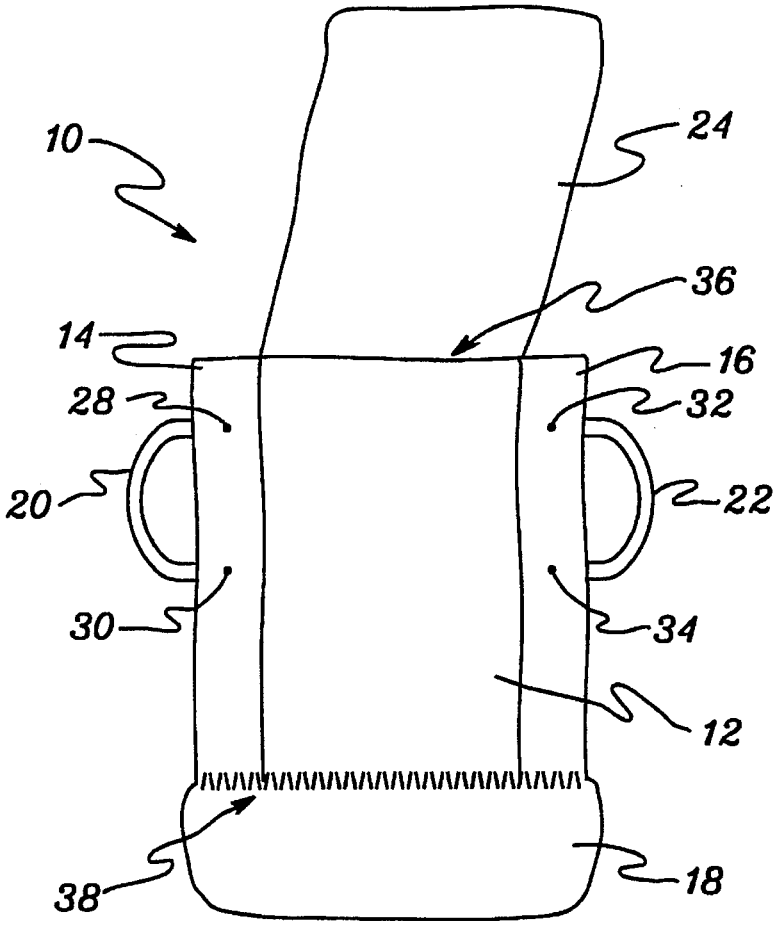
FIG. 1 depicts a front view of a mail carrier according to a first aspect of the present invention.

FIG. 1 is a front view of a mail carrier 10 according to the present invention. Mail carrier 10 comprises a flat, stiff back portion 12, a pair of stiff moveable flaps 14 and 16, a pouch 18, a pair of handles 20 and 22 and a water-repelling flap 24.

Figure 2:
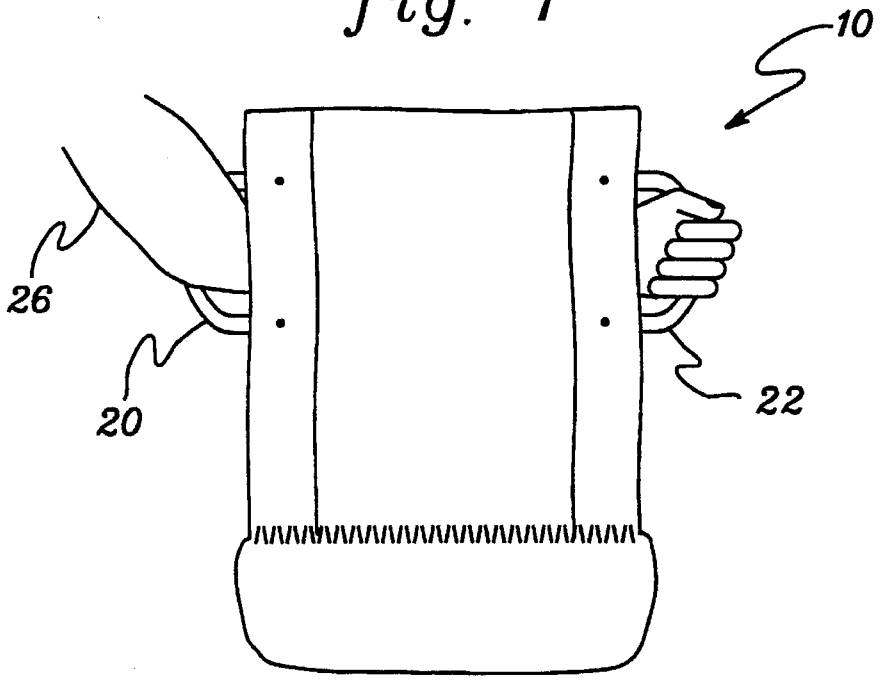
FIG. 2 depicts the mail carrier of FIG. 1 in use by a mailperson.

FIG. 2 depicts mail carrier 10 in a preferred use. A mailpersons's forearm 26 is placed through handles 20 and 22 as shown. Mail carrier 10 is designed to hold mail larger than letter-sized mail, for example, magazines. Carrier 10 allows the mailperson's other arm to be free for removing mail from carrier 10 and placing it in mail boxes. It will, however, be understood that mail carrier 10 is capable of holding letter-sized mail, although it is preferably used for larger-sized mail. It will also be understood that a mailperson could cradle carrier 10 without using handles 20 and 22. If carried in this manner, the handles may not be necessary.

Details regarding mail carrier 10 will now be provided. Flat, stiff back portion 12 and stiff moveable flaps 14 and 16 are each comprised of two layers of a heavy-duty material 70 and 72 respectively (see FIG. 5), such as canvas or the like, with a stiff insert 74 (see FIG. 5) therebetween. The canvas-like material may be, for example, marine fabric. In addition, the stiff insert for back portion 12 and flaps 14 and 16 may be plastic. Handle 20 is attached to flap 14 by heavy-duty stitches 28 and 30. Similarly, handle 22 is attached to flap 16 by heavy-duty stitches 32 and 34. Water-repelling flap 24 is attached to back portion 12 at the top 36 thereof. Water-repelling flap 24 may comprise, for example, clear plastic. Flap 24 serves the purpose of protecting what is being held within mail carrier 10 from inclement weather. Flap 24 being clear allows the mail carrier to view the contents of mail carrier 10 during such inclement weather, enabling the mail carrier to quickly choose and remove the contents of mail carrier 10. When the weather is clear, water-repelling flap 24 may be folded down in contact with back portion 12 and the bottom thereof tucked inside pouch 18, and items may be placed in mail carrier 10 on top thereof. Pouch 18 is also preferably comprised of a canvas-like material. At the top of pouch 18 is elastic 38 for ensuring that the contents of mail carrier 10 stay within the carrier and do not fall out.

Figure 3:
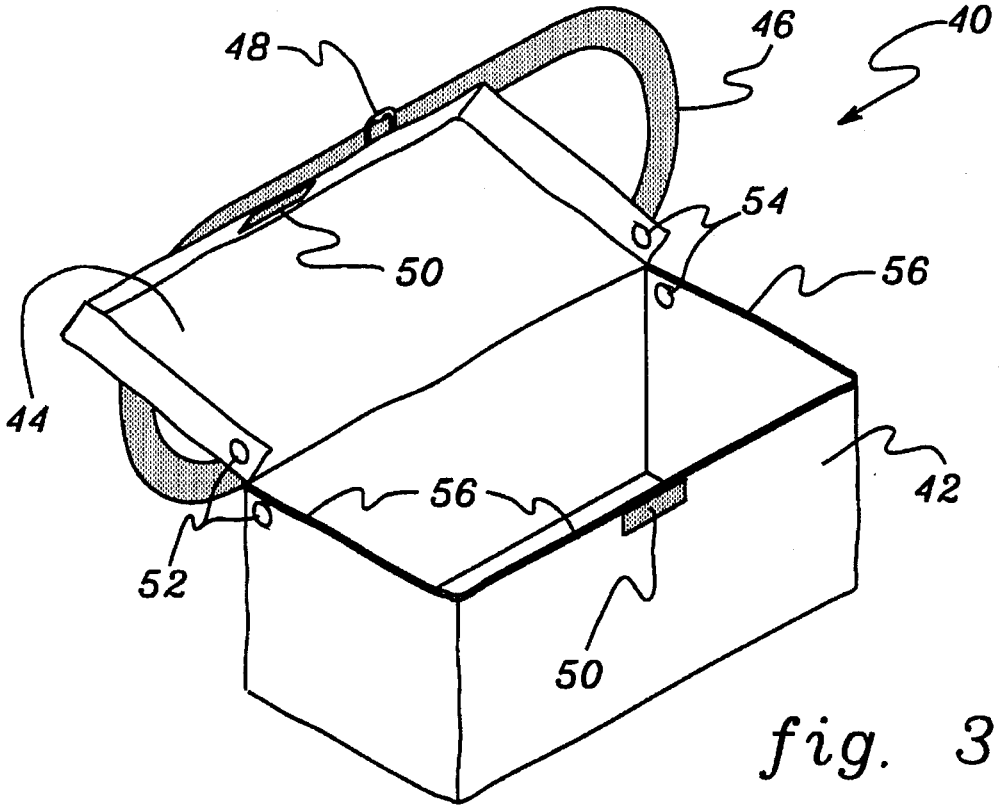
FIG. 3 depicts a front view of a mail carrier according to a second aspect of the present invention, with the cover thereof open.

FIG. 3 depicts a second mail carrier 40 according to the present invention. Mail carrier 40 comprises sack 42, cover flap 44, strap 46, strap adjuster 48, hook and loop type closure 50, snap connectors 52 and 54 and rigid member 56.

Mail carrier 40 may be worn on the shoulder or it may be worn around the waist of a mailperson and is designed to hold letter-sized mail. Strap adjuster 48 allows the mailperson to adjust the length of strap 46. Rigid member 56 extends over the front panel of sack 42 and over the side panels thereof. Rigid member 56 keeps sack 42 open and helps same to retain its shape. Rigid member 56 may, for example, be a metal rod. Rigid member 56 is sewn into the top of sack 42, which is preferably made of a canvas-like material. Cover flap 44 covers sack 42 to protect the contents thereof from inclement weather. When cover flap 44 is actively covering sack 42, hook and loop type closure 50 keeps it in place, as well as snap connectors 52 and 54.

Figure 4:
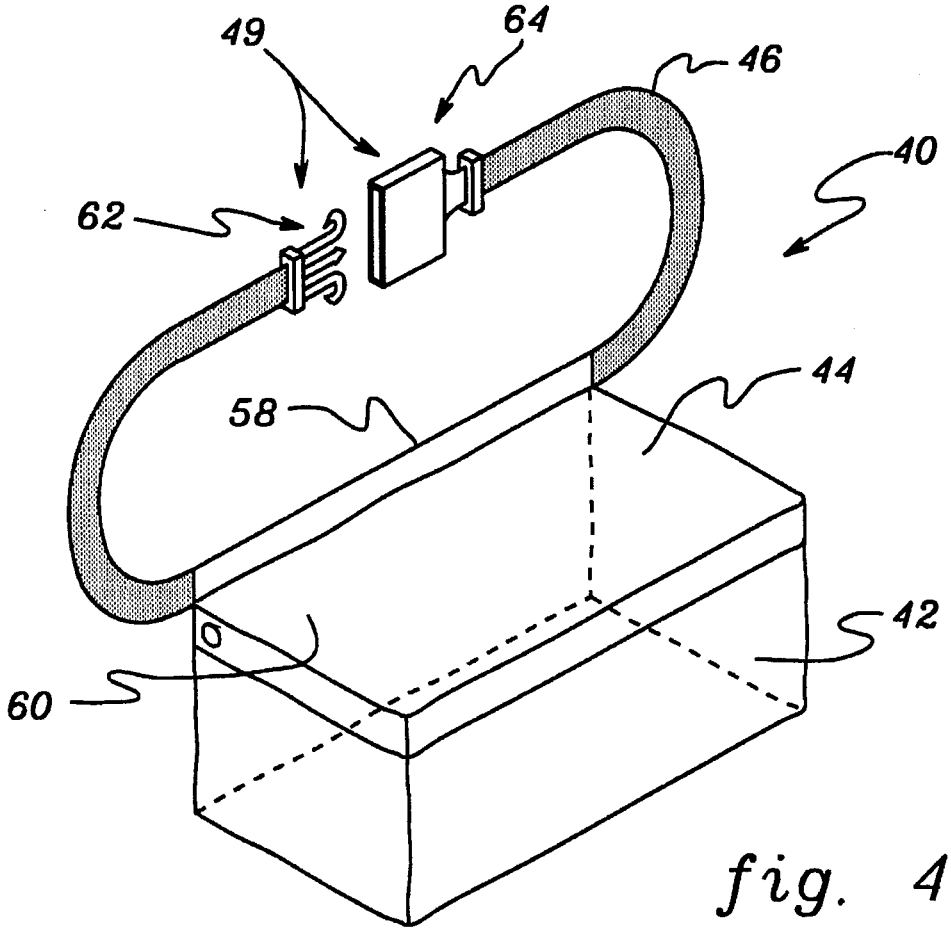
FIG. 4 depicts the mail carrier of FIG. 3 with the cover down and belt released.

FIG. 4 depicts mail carrier 40 of FIG. 3 with the cover flap 44 actively covering sack 42. Also shown in FIG. 4 is strap holder 58, which is attached to the back panel 60 of sack 42. Strap holder 58 comprises two layers of the canvas-like material through which strap 46 is inserted. FIG. 4 also depicts a quick attach/release mechanism 49. Mechanism 49 allows carrier 40 to be worn around the waist of a mailperson and comprises a male connector portion 62 and a female connector portion 64. Mechanism 49 may also include a strap adjuster. One example of such a mechanism is described in U.S. Pat. No. 4,150,464 issued to Tracy and entitled, "Buckle". Another exemplary embodiment of quick attach/release mechanism 49 is a hook and loop type closure.

Although described separately above, mail carriers 10 and 40 may be used together as a mail carrier system. Mail carriers 10 and 40 cooperate with each other to allow a mail carrier to carry mail separated according to size. Modern postal service practice is to combine letter-sized mail with larger-sized mail, such as magazines. Thus, the mailperson may put the letter-sized mail in mail carrier 40 and put the larger-sized mail in mail carrier 10. The use of mail carriers 10 and 40 together frees one arm of the mail carrier to actually deliver the mail, and arranges the mail efficiently. In this way, a mailperson can efficiently carry and deliver the mail.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

We claim:

1. A mail carrier for assisting a mailperson with carrying mail, comprising:

a flat back portion having a top edge and two side edges, wherein said flat back portion is vertically stiff;

a pair of stiff side flaps, each stiff side flap being moveable along a vertical axis and connected to a respective one of said two side edges;

an open pouch connected to said flat back portion at a lower half thereof, wherein an upper half of said flat back portion extends above said open pouch; and a pair of handles, each handle being connected to a respective one of said pair of stiff side flaps, wherein said pair of handles allow said mail carrier to be suspended along the length of said mailperson's forearm.

2. The mail carrier of claim 1 wherein each of said pair of stiff side flaps and said flat back portion comprises two layers of a canvas-like material and a stiff insert therebetween.

3. The mail carrier of claim 1 further comprising a water-repelling flap connected at said top edge of said flat back portion for covering mail carrier contents.

4. The mail carrier of claim 1, wherein said open pouch comprises elastic around an opening thereof.

5. A mail carrier for assisting a mailperson with carrying mail, comprising:

a sack including a front panel, a back panel, two side panels connecting said front panel and said back panel, and a bottom panel connected to each of said front panel, said back panel and said two side panels;

a rigid member connected to said sack at a top of each of said front panel and two side panels for holding said sack open and for retaining a shape thereof;

a strap sized to fit around said mailperson's waist and coupled to said sack for carrying same about said mailperson's waist; and a cover flap for said sack connected to said back panel at a connection area.

6. The mail carrier of claim 5 further comprising a hook and loop type closure for releasably securing said cover flap to said sack.

7. The mail carrier of claim 5 further comprising a snap connector for connecting said cover flap to one of said two side panels and positioned adjacent an end of said connection area.

8. The mail carrier of claim 5 wherein said sack and said cover flap comprise a canvas-like material.

9. The mail carrier of claim 5, wherein said rigid member comprises a metal rod.

10. The mail carrier of claim 9, wherein said metal rod comprises a first portion, a second portion and a third portion, wherein said second portion is parallel with said third portion and wherein each of said second portion and said third portion is perpendicular to said first portion.

11. The mail carrier of claim 5, wherein said strap comprises a quick release mechanism.

12. The mail carrier of claim 5, wherein said strap comprises a strap adjuster.

13. A mail carrier system for assisting a mailperson with carrying mail, comprising:

a first mail carrier sized for carrying letter-sized mail, comprising:

a sack including a front panel, a back panel, two side panels connecting said front panel and said back panel, and a bottom panel connected to each of said front panel, said back panel and said two side panels, a cover flap for said sack connected panel at a connection area, a rigid member connected to said sack at a top of each of said front panel and two side panels for holding said sack open and for retaining a shape thereof, and a strap sized track fit around said mailperson's waist, and connected to said sack for carrying same about said mailperson's waist; and a second mail carrier sized for carrying mail larger than said letter-sized mail, comprising:

a flat back portion having a top edge and two side edges, wherein said flat back portion is vertically stiff.

a pair of stiff side flaps, each stiff side flap being moveable along a vertical axis and connected to a respective one of said two side edges.

an open pouch connected to said flat back portion at a lower half thereof, wherein an upper half of said flat back portion extends above said open pouch; and a pair of handles, each handle being connected to a respective one of said pair of stiff side flaps, wherein said pair of handles allow said mail carrier to be suspended along the length of said mailperson's forearm.

14. The mail carrier system of claim 13, wherein said rigid member comprises a metal rod connected to said sack at a top of each of said front panel and said two side panels.

* * * * *

UNITED STATES PATENT AND TRADEMARK OFFICE

CERTIFICATE OF CORRECTION

PATENT NO. : 5,586,700

DATED : December 24, 1996

INVENTOR(S) : Fitzner et al.

It is certified that error appears in the above-indentified patent and that said Letters Patent is hereby corrected as shown below:

Column 5

Line 1, insert --to said back-- between "connected" and "panel"

Line 6, substitute --track-- for "to".

Line 13, substitute --,-- for ".".

Line 16, substitute --,-- for ".".

Signed and Sealed this

Seventeenth Day of June, 1997

Bruce Lehman

*Attest:*

BRUCE LEHMAN

*Attesting Officer*

*Commissioner of Patents and Trademarks*